United States Patent [19]

Hall

[11] Patent Number: 4,686,889

[45] Date of Patent: Aug. 18, 1987

[54] VARIABLE HEIGHT COLUMN WITH INTEGRAL ACTUATING MEANS

[75] Inventor: George D. Hall, Erie, Pa.

[73] Assignee: American Sterilizer Company, Erie, Pa.

[21] Appl. No.: 684,604

[22] Filed: Dec. 21, 1984

[51] Int. Cl.[4] ..... F01B 15/02; F01B 1/00

[52] U.S. Cl. ..... 92/117 A; 92/146; 91/217; 384/42

[58] Field of Search ..... 92/146, 61, 117 R, 117 A, 92/151, 152; 91/217, 520, 216 R; 187/95; 212/269; 308/3 R

[56] References Cited

U.S. PATENT DOCUMENTS

| | | | |
|---|---|---|---|
| 180,252 | 7/1876 | McClunie | 187/95 X |
| 628,953 | 7/1899 | McConville | 91/217 |
| 2,393,503 | 1/1946 | Bosomworth et al. | 91/217 |
| 2,490,625 | 12/1949 | Hall | 91/217 |
| 2,546,462 | 3/1951 | Link | 92/146 |
| 2,821,264 | 1/1958 | Ulinski | 92/146 |
| 3,537,762 | 11/1970 | Lödige | 308/3 R |

*Primary Examiner*—Robert E. Garrett
*Assistant Examiner*—Mark A. Williamson
*Attorney, Agent, or Firm*—Robert D. Yeager; Christine R. Ethridge

[57] ABSTRACT

A variable height column having a base, a midsection and an upper section. The base includes at least one upwardly extending guide shaft and the upper section includes at least one downwardly extending guide shaft. The midsection includes guide paths and bearings dimensioned for sliding engagement with the guide shaft. Hydraulic actuating means are provided to move the midsection vertically relative to the base and to move the upper section vertically relative to the midsection at the same rate to permit the uniform straightline extension and retraction of the column.

11 Claims, 7 Drawing Figures

VARIABLE HEIGHT COLUMN WITH INTEGRAL ACTUATING MEANS

BACKGROUND OF THE INVENTION

1. Field of the Invention

The present invention relates to variable height columns, and more specifically, to fluid actuated columns.

2. Description of the Prior Art

Commercially available load support surfaces, such as surgical tables, may include variable height columns which can be raised and lowered by fluid actuated cylinders. One type of cylinder includes a sliding way system with a single acting cylinder separate from the column. The separate external cylinder provides a bulky arrangement. Another commercially available column includes a concentric sliding way system with an integral single acting hydraulic cylinder as the motive force. The internal cylinder, with its piston and rod, requires finely finished internal surfaces to prevent excessive friction when raising or lowering the column. The manufacturing costs for such finely finished materials are high.

The conventional columns must be positioned near the center of gravity of the load support surface and its load to limit the bending moment on the column. Excessive bending moments on the columns lead to early column failure. The friction force of the way system is proportional to the bending moment and the coefficient of friction of the materials. A low coefficient of friction will permit a much larger bending moment before the column fails. Conventional sliding way system columns have high coefficients of friction.

Columns having rolling element way systems have relatively low coefficients of friction and thus, will tolerate greater bending moments, but are limited by contact stress between the rollers and the track of the way systems. Furthermore, rolling element systems are bulky.

In order to increase the extension of columns, two stage motive forces have been designed. The rate of motion, however, from one stage to the next is not uniform. Greater weight must be lifted in the first stage, thus, the rate of motion is relatively slow. The second stage is more rapid. When raising a patient support surface, a uniform rate of motion is preferred.

It is an object of the present invention to provide a variable height column which permits a streamlined, easily manufactured structure by providing an internal motive force which does not require finely finished internal surfaces. It is a further object of the present invention to provide a variable height column which has a uniform rate of motion and a large extended to collapsed ratio.

Finally, it is an object of the present invention to provide a column having a low coefficient of friction with a high load bearing capacity to permit greater tolerance to bending moments so that the column can be positioned away from the center of gravity of the load support surface and its load.

SUMMARY OF THE INVENTION

The present invention provides a variable height column having a base, a housing and means for actuating the vertical movement of the housing relative to the base. The base includes at least one upwardly extending base guide member and the housing is adapted for straightline vertical movement relative to the base along the base guide member. The actuating means, preferably a hydraulic ram system, is so associated with the base and so integrally incorporated in the housing that the actuating means pushes the housing uniformly upward for extension relative to the base and is received within the housing for retraction relative to the base.

In the preferred embodiment, the hydraulic ram is so received into the housing that the ram contacts the housing at a single contact surface.

The column preferably also includes an upper section having at least one downwardly extending upper guide member. The upper section is adapted for straightline vertical movement relative to the housing, or midsection, along the upper guide member. The actuating means is so associated with the upper section that the actuating means pushes the upper section uniformly upward for extension relative to the housing and is received within the housing to retract the upper section relative to the housing. The actuating means is adapted to move the upper section relative to the housing at the same rate as it moves the housing relative to the base to provide uniform extension and retraction of the column.

BRIEF DESCRIPTION OF THE DRAWINGS

The following detailed description of the preferred embodiment can better be understood if reference is made to the drawings in which.

DETAILED DESCRIPTION OF THE PREFERRED EMBODIMENTS

Figure 1:
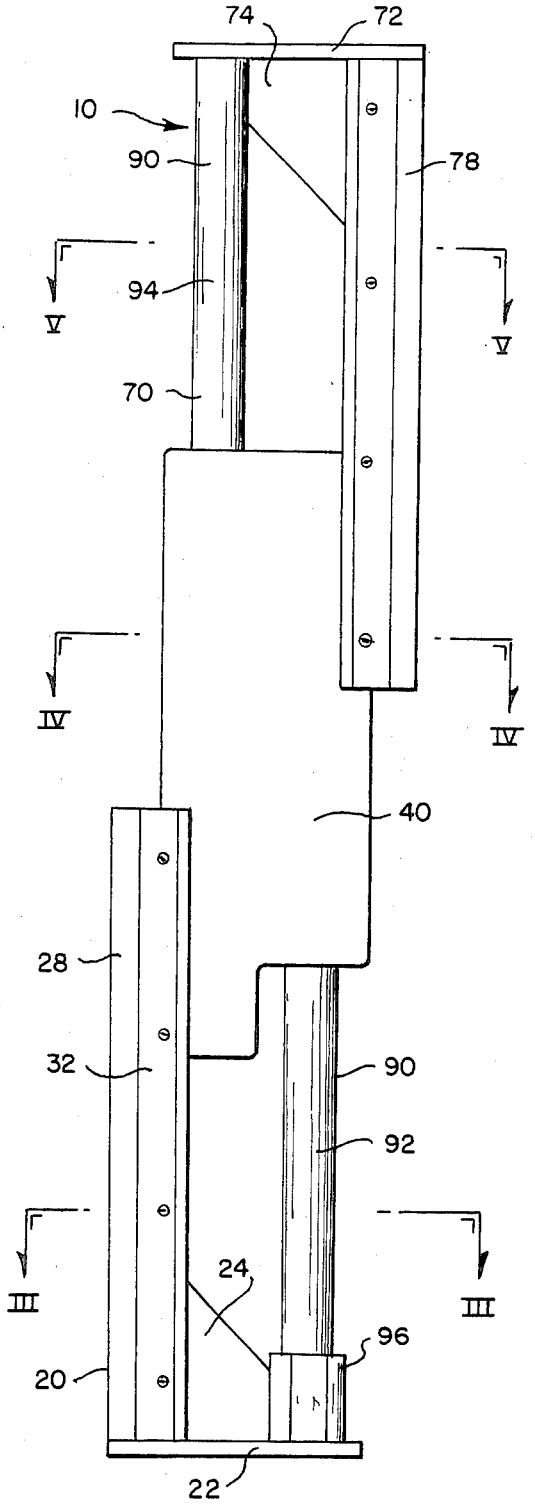
FIG. 1 is a side elevation view of the preferred embodiment of the column of the present invention in an extended position.

FIGS. 1 through 7 illustrate the preferred embodiments of the variable height column 10 of the present invention.

Column 10 includes base 20, midsection 40, upper section 70 and actuating means 90.

Figure 3:
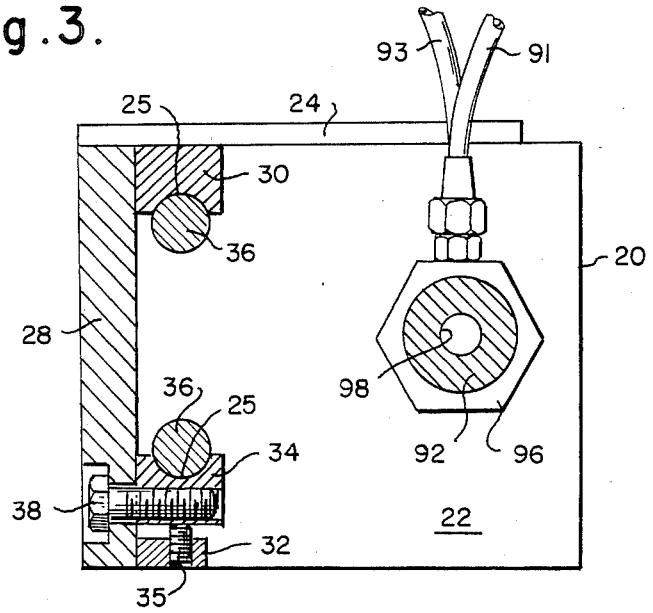
FIG. 3 is a section view of the base of the column of FIG. 1 along line III—III.

Referring to FIGS. 1 and 3, base 20 includes base plate 22, a gusset 24 and a side panel 28. A stationary guide mount 30 extends upwardly in a vertical orientation relative to base plate 22 and is preferably welded to side panel 28.

A movable guide mount 34 is attached to side panel 28 by bolts or clamps 38. An adjusting bar 32 is welded along one corner of side panel 28 and extends upwardly from base plate 22. A plurality of screws 35 are placed along the length of the adjusting bar 32 to permit adjustment of movable guide mount 34. Adjustment of guide mount 34 corrects any play between the guide shaft 36 connected to mount 34 and the bearing 44 on the guide path 42 of midsection 40, which will be described in more detail below. Such correction maintains the straightline vertical movement of column 10 and lowers friction between the sliding surface of the elements 36 and 44.

At least one guide shaft 36, and preferably two as shown in FIG. 3, extend upwardly from the base plate 22. Each guide mount, 30 and 34, has a surface 25 dimensioned to compliment the exterior surface of the guide shaft 36. Surface 25 need not provide a mating surface as shown in FIG. 3, but may instead, be any suitable stabilizing surface. Each guide shaft 36 is mounted to a guide mount, 30 or 34, by any suitable means, such as a screw. The guide shafts 36 are preferably made of metal, such as case hardened and ground steel to provide the extended operating life and desired surface finish.

Figure 2:
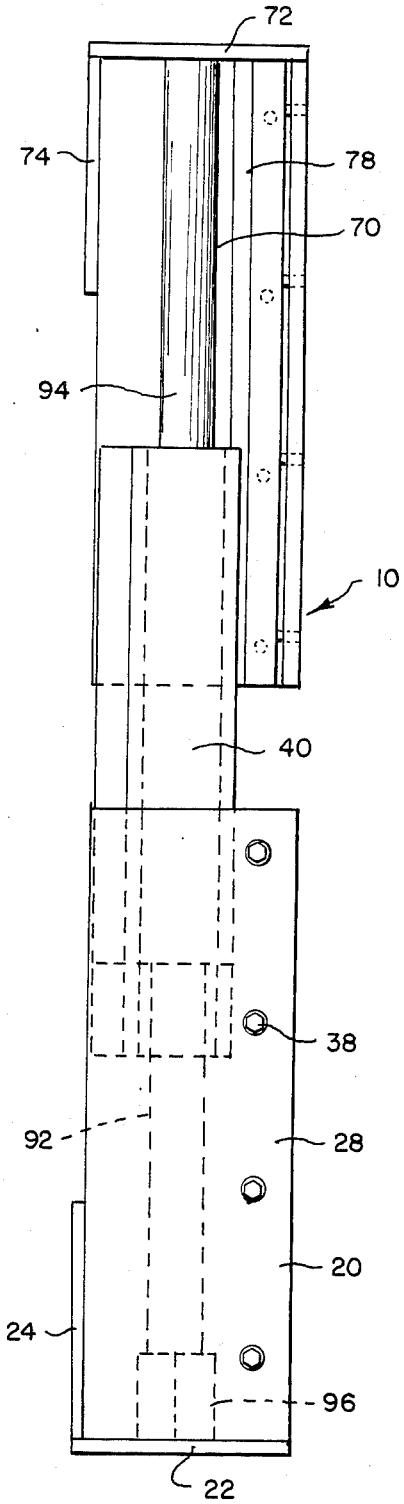
FIG. 2 is an end view of the column of FIG. 1 as viewed from the left.
Figure 4:
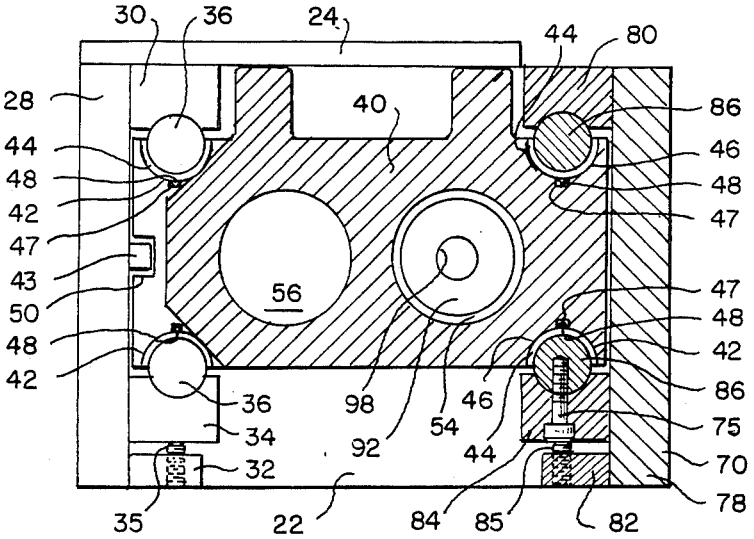
FIG. 4 is a section view of the midsection of the column of FIG. 1 along line IV—IV.
Figure 5:
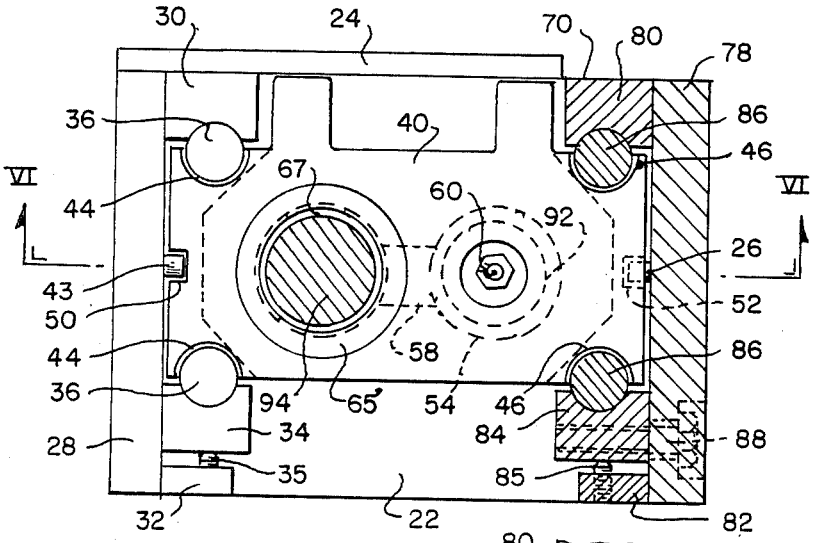
FIG. 5 is a section view of the upper section and a partial top plan view of the midsection of the column of FIG. 1 along line V—V.

The mid section 40, as shown in FIGS. 1, 2, and 4, includes guide paths 42 having concave surfaces 46. The guide paths 42 are preferably cut out concave grooves dimensioned for alignment with guideshafts 36 of base 20 and guide shafts 86 of upper section 70. Bearings 44 are fixedly attached to the surface 46 of guide-paths 42 and are dimensioned for sliding engagement with guide shafts 36 and 86. Bearings 44 may be held in place along paths 42 mechanically by protrusions 48 which extend into holes 47 in midsection 40 as shown in FIG. 4. Alternatively, bearings 44 may be glued in place, as shown in FIG. 5.

There are preferably two bearings 44 on each path 42. The half-journal bearings 44 are preferably made of self-lubricating woven Teflon ® to provide a teflon-to-metal interface for low friction sliding contact. Alternatively, the bearings 44 may be roller bearings or ball bearings for a rolling element way system rather than a sliding way system.

A cut out groove 50 in midsection 40 and a screw, or any suitable extension 43 near the uppermost part of base side panel 28 provides a stop to limit the extension of midsection 40 relative to base 20. A similar stop 26 and groove 52 are provided to limit the extension of upper section 70 relative to midsection 40.

Upper section 70 includes upper plate 72, gusset 74 and side panel 78. A stationary guide mount 80, movable guide mount 84, adjusting bar 82 and guide shafts 86, similar to the corresponding structures of base 20, are shown in FIGS. 2 and 5. Bolts 88 retain movable guide mount 84 in upper side panel 78 and screws 75 mount the shaft 86 to the guide mount 84. Adjusting screws 85, similar in function to screws 35, are described above. Guide shafts 86 slide along bearings 44 of paths 42 when upper section 70 moves vertically relative to midsection 40.

Figure 6:
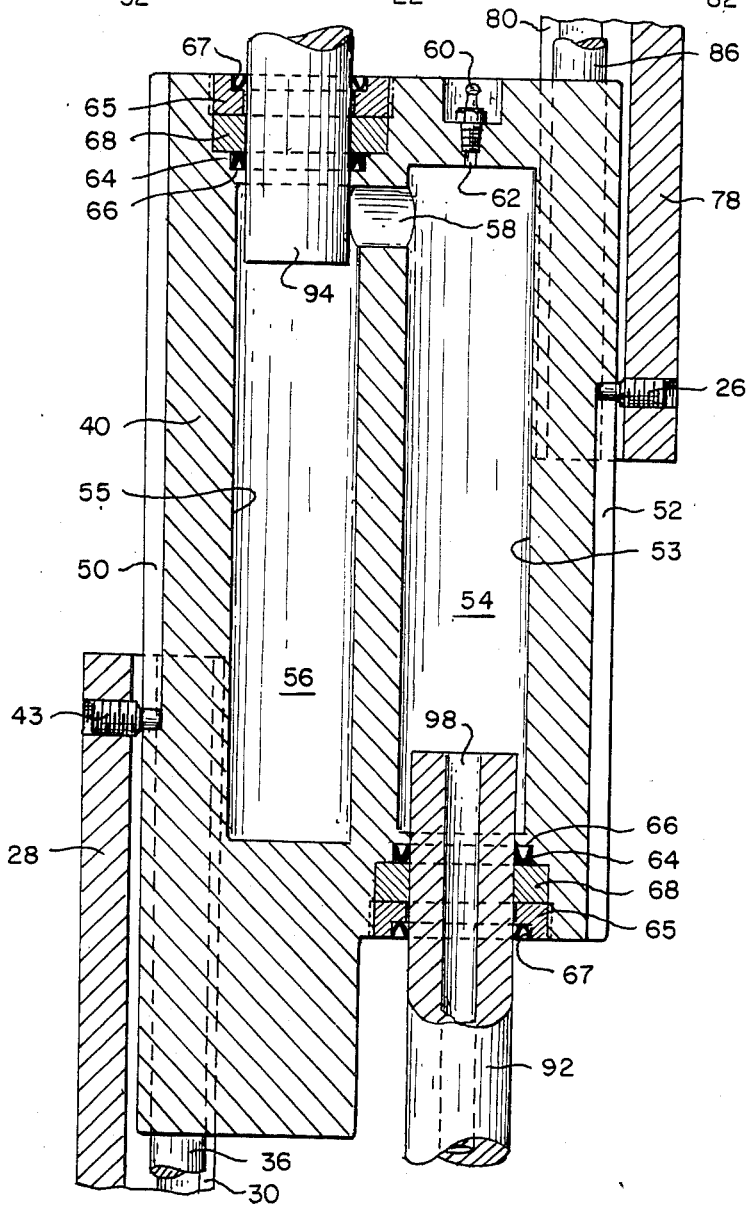
FIG. 6 is a cross sectional view generally taken through line VI—VI of FIG. 5.

Midsection 40 provides a housing for the actuating means 90. Cavity 54 has inner surface 53. Cavity 56 has inner surface 55. A passage 58 connects cavities 54 and 56 near the upper most portion of midsection 40 as shown in FIGS. 5 and 6. A bleed valve 60 is provided to bleed the system. A passage 62 connects bleed valve 60 to cavity 54 near passage 58.

A first ram 92 is operatively connected to a valve block 96 on base plate 22 and extends into cavity 54 without touching surface 53. An axial passage 98 through ram 92 provides a fluid flow path to cavity 54. Lines 91 and 93 connect the actuating means 90 of column 10 to a source of fluid. Actuating means 90 is preferably a hydraulic system, but may be a pneumatic system. Line 91 provides pressure and fluid flow to extend column 10 and line 93 provides pressure to open a pilot operated check valve in valve block 96 to permit the retraction of column 10. The axial passage 98 through ram 92 eliminates the need to direct lines 91 and 93 directly to the cavities 54 and 56 in midsection 40.

A second ram 94 is operatively connected to the upper plate 72 and extends into cavity 56 without touching surface 55. A recess in plate 72 receives one end of ram 94. Unlike ram 92, ram 94 does not include an axial fluid passage.

Referring to FIG. 6, rams 92 and 94 have identical seals 64 and bearings 68 where they enter cavities 54 and 56, respectively, in midsection 40. Each seal 64 is disposed in a recess 66, shown in FIG. 6. A threaded nut 65 holds each bearing 68 in place. A wiper member 67 prevents dust or other debris from reaching the bearing 68 and seal 64.

When the column 10 is retracted upper ram 94 is housed within cavity 56 and lower ram 92 is housed within cavity 54, in midsection 40. Guide shafts 36 of base 20 and guide shafts 86 of upper section 70 are in the concave guide paths 42 of midsection 40. In operation, hydraulic fluid is directed through line 91 to valve block 96, through the axial passage 98 of ram 92 and into cavity 54. The fluid proceeds through cavity 54 to passage 58 and into cavity 56.

When cavity 56 is filled, continued fluid flow pushes ram 94 upwards, thus vertically extending upper section 70 relative to midsection 40. Then the continued fluid flow pushes midsection 40 vertically upwards relative to base 20. If all the bearings 68 and 44 have been adjusted to provide uniform friction, ram 94, and upper section 70 will extend first because the weight bearing against them is less than that bearing down on midsection 40. However, if the way system is adjusted to provide greater friction on the upper section 70 than the midsection 40, thus countering the weight differential, the midsection 40 can be made to extend first. Regardless of the section, 40 or 70, that moves first, the uniform fluid flow through the integral hydraulic actuating means 90 provides a uniform rate of extension from one stage to the next.

In the extended position, shown in FIGS. 1 and 2, bearings 44 of guide paths 42 slide along guide shafts 36 and guide shafts 86 slide upwardly along the bearings 44 on the guide paths 42 with which they are aligned to provide a uniform straightline vertical extension of column 10.

While extending or retracting, the rams 92 and 94 only contact the respective bearings 68 in cavities 54 and 56. Thus, each ram, 92 and 94 only contacts the midsection, or housing, 40 at one contact surface, bearing 68. The inner surfaces, 53 and 55, of cavities 54 and 56, do not provide frictional contact with the rams, and thus, do not have to be finely finished to minimize such friction as is required with cylinders having pistons which contact the cylinder's interior.

To retract the column 10, pressure is provided through line 93 to open the check valve and uniformly drain the fluid. Ram 94 moves into cavity 56, and cavity 54 moves down over ram 92.

The design of variable height column 10 of the present invention allows a large extended to collapsed height ratio due to the three sectioned, double stage extension. The integral hydraulic system arrangement permits uniform movement of the sections thus permitting a uniform rate of motion, unlike the separate two stage movement of conventional columns. The way system provides straightline vertical guided movement which permits the use of the simple, integral hydraulic rams.

The guide shafts, 36 and 86, are preferably made of case hardened and ground steel, so that the coefficient of friction between the self-lubricating woven teflon® bearings 44 and the shafts, 36 and 86, is low. The large contact area between the bearings 44 and the shafts 36 and 86 of the way system provides a high load capacity. The combination of the low coefficient of friction and the high load capacity permits improved tolerance to bending moments, thus allowing placement of the column away from the center of gravity of the load support surface and the load.

Figure 7:
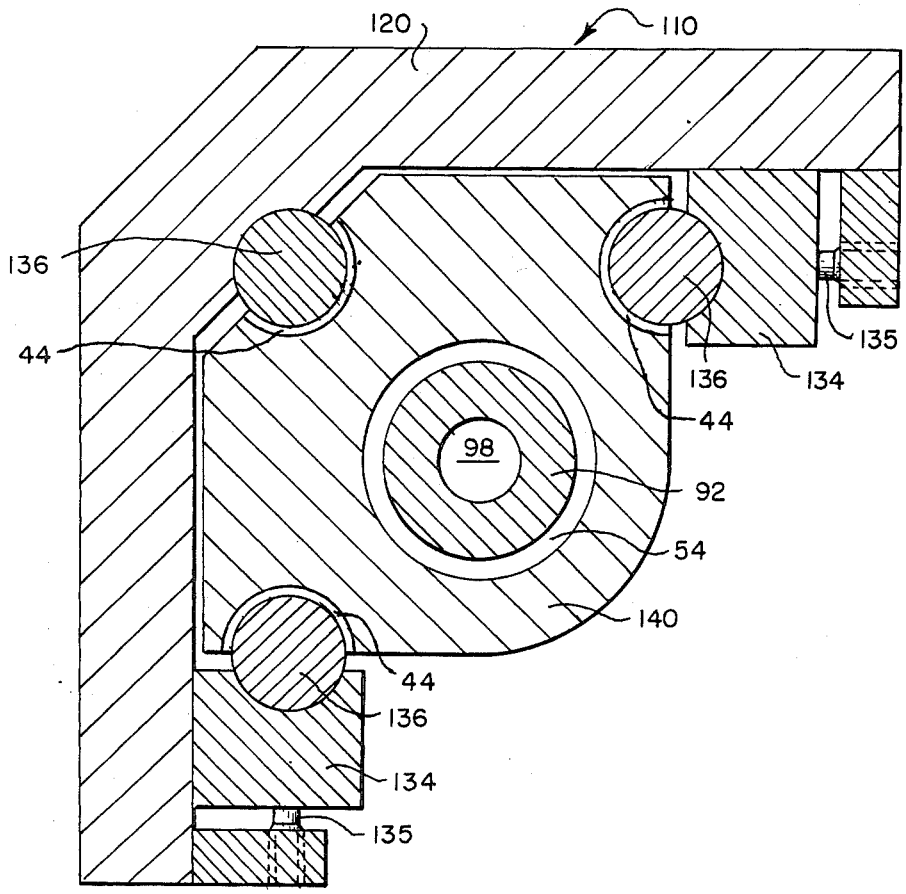
FIG. 7 is a cross section view of an alternative embodiment of the column of the present invention.

An alternative embodiment of the column 110, shown in FIG. 7 has a single stage structure which includes only a base 120 and a midsection, or housing 140. Although one or two guide shafts 136 will suffice, three guide shafts 136 may be provided to increase the stability and load capacity of the single stage structure. Two of the three guide shafts 136 are adjustable by means of adjusting screws 135 and movable guide mounts 134 to permit equalization of the load bearing capacity. The upper ram 94, cavity 56, passage 58 and the upper section 70 with its upper way system are not included in the single stage structure.

In another alternative arrangement (not shown), the column of the present invention may employ a rolling element way system rather than a sliding element way system. The guide shafts 36 and 86 may be replaced with rollers which engage tracks on the midsection 40 instead of the bearings 44 and guide paths 42. The tracks can be placed on the base and upper sections, 20 and 70, and the rolling element can be attached to the midsection 40. As stated above, the bearings 44 may be roller bearings or ball bearings. The guide shafts, 36 and 86, would slidingly engage the roller or ball bearings. Finally, a cam roller may be used to contact the guide shafts. The same actuating means 90 would be employed.

What is claimed is:

1. A variable height column for supporting a load support surface comprising:

a base having a plurality of upwardly extending base guide members;

a midsection having a plurality of guide paths, said midsection being adapted for vertical movement relative to said base;

an upper section having a plurality of downwardly extending upper guide members, said upper section being adapted for vertical movement relative to said midsection; said base guide members and said upper guide members being dimensioned to travel along said guide paths; and hydraulic means for actuating the vertical movement of said mid and upper sections, said actuating means so operatively connecting said base and said midsection that said actuating means pushes said midsection upwards along said base guide members for extension relative to said base and is received within said midsection for retraction of said midsection relative to said base, and said actuating means so operatively connecting said upper section and said midsection that said actuating means pushes said upper section upwards along said upper guide members for extension relative to said midsection and is received within said midsection for retraction of said upper section relative to said midsection, said actuating means being adapted to move said upper section relative to said midsection at the same rate as it moves said midsection relative to said base to provide uniform extension and retraction of said column.

2. A column as recited in claim 1 wherein each of said plurality of guide paths has a bearing surface dimensioned for sliding engagement with one of said plurality of base and upper guide members.

3. A column as recited in claim 2 wherein said bearing surface of each of said plurality of guide paths is a self-lubricating material having a protrusion, and each said path includes a hole for so receiving said protrusion that said bearing surface is fixedly attached to said path.

4. A column as recited in claim 2 wherein said bearing surface is a self-lubricating woven material.

5. A column as recited in claim 1 further comprising means to adjust the friction between at least one of said plurality of base guide members and the corresponding midsection guide paths and means to adjust the friction between at least one of said plurality of upper guide members and the corresponding midsection guide path.

6. A column as recited in claim 1 wherein said base and upper guide members are shafts.

7. A column as recited in claim 1 wherein said hydraulic actuating means has a first ram operatively connected to said base and a second ram connected to said upper section;

said midsection defining a first cavity for receiving said first ram, a second cavity for receiving said second ram and a passage for operatively connecting said first and second cavities;

said first and second rams being so associated with said first and second cavities, respectively that each said ram maintains such a spaced relationship relative to said respective cavity that each of said ram contacts said midsection only at respective single contact surfaces; and said first ram has an axial passage therethrough to permit the flow of hydraulic fluid to said first and second cavities.

8. A variable height column comprising:

a base having at least one upwardly extending base guide member and at least one upwardly extending base guide mount along which said base guide member is adjustably attached;

a housing adapted for straightline vertical movement relative to said base along said base guide member, said housing having a path disposed vertically thereon, said path having a bearing surface attached thereto for sliding engagement with said base guide member;

means for adjusting said base guide member along said base guide mount to maintain the straightline vertical movement of said housing relative to said base and to adjust the friction between said base guide member and said bearing surface; and means for actuating the vertical movement of said housing, said actuating means being so associated with said base and so integrally incorporated in said housing that said actuating means pushes said housing uniformly upwards along said guide member for extension of said housing relative to said base and is received within said housing for retraction of said housing relative to said base.

9. A column as recited in claim 8 wherein said actuating means is fluid powered and has a ram so received within said housing that said ram contacts said housing at a single contact surface during extension and retraction of said column.

10. A column as recited in claim 8 further comprising:

an upper section having at least one downwardly extending upper guide member, said upper section being adapted for straightline vertical movement relative to said housing along said upper guide member; and said actuating means being so associated with said upper section that said actuating means pushes said upper section uniformly upwards for extension of said upper section relative to said housing and is received within said housing for retraction of said upper section relative to said housing, said actuating means being adapted to move said upper section relative to said housing at the same rate as it moves said housing relative to said base to provide uniform extension and retraction of said column.

11. A column as recited in claim 10 wherein said actuating means is fluid powered and has a first ram operatively connected to said base and a second ram operatively connected to said upper section;

said housing defines a first cavity for receiving said first ram, a second cavity for receiving said second ram and a passage for operatively connecting said first and second cavities to provide such uniform motion; and said first and second rams being so associated with said first and second cavities, respectively, that each of said rams contacts said housing only at respective single contact surfaces.

* * * * *

UNITED STATES PATENT AND TRADEMARK OFFICE

CERTIFICATE OF CORRECTION

PATENT NO. : 4,686,889

DATED : August 18, 1987

INVENTOR(S) : George D. Hall

It is certified that error appears in the above—identified patent and that said Letters Patent is hereby corrected as shown below:

Col. 6, line 35, delete "of".

Signed and Sealed this

Second Day of February, 1988

*Attest:*

DONALD J. QUIGG

*Attesting Officer*

*Commissioner of Patents and Trademarks*